US011336984B2

(12) United States Patent
Wilson

(10) Patent No.: US 11,336,984 B2
(45) Date of Patent: May 17, 2022

(54) HEADPHONE SYSTEM

(71) Applicant: Chris Wilson, Pratt, WV (US)

(72) Inventor: Chris Wilson, Pratt, WV (US)

( * ) Notice: Subject to any disclaimer, the term of this patent is extended or adjusted under 35 U.S.C. 154(b) by 0 days.

(21) Appl. No.: 16/383,547

(22) Filed: Apr. 12, 2019

(65) Prior Publication Data

US 2020/0267465 A1 Aug. 20, 2020

Related U.S. Application Data

(60) Provisional application No. 62/807,209, filed on Feb. 18, 2019.

(51) Int. Cl.
*H04R 1/10* (2006.01)
*H04R 1/08* (2006.01)

(52) U.S. Cl.
CPC ..... *H04R 1/1025* (2013.01); *H04R 1/083* (2013.01); *H04R 1/1008* (2013.01); *H04R 2420/07* (2013.01)

(58) Field of Classification Search
None
See application file for complete search history.

(56) References Cited

U.S. PATENT DOCUMENTS 3,518,375 A * 6/1970 Hawkins ..... H03G 3/32 381/80
4,881,123 A * 11/1989 Chapple ..... H04R 3/00 381/104
5,647,011 A * 7/1997 Garvis ..... H03G 3/342 381/104
6,704,428 B1 3/2004 Wurtz
9,398,367 B1 7/2016 Scott
2004/0145491 A1* 7/2004 Nascimento ..... B60R 25/24 340/13.31
2006/0116073 A1* 6/2006 Richenstein ..... H04H 20/62 455/3.06
2007/0206829 A1* 9/2007 Weinans ..... H04M 1/6066 381/370
2008/0013778 A1* 1/2008 Lee ..... H04M 1/6033 381/385
2014/0064511 A1 3/2014 Desai
2015/0119136 A1 4/2015 Kulavik
2015/0217191 A1* 8/2015 Yan ..... A63F 13/235 463/37
2016/0112787 A1 8/2016 Rich

OTHER PUBLICATIONS

Gilroy, Amy. "Unwired Technology Will Debut Pilot Override Bluetooth System." Twice, Nov. 2, 2017. (Year: 2017).*

* cited by examiner

*Primary Examiner* — James K Mooney
(74) *Attorney, Agent, or Firm* — Michael C. Balaguy

(57) ABSTRACT

A headphone system including a headphone in wireless communication with a remote-controller to be used in combination for direct communication between a first-user and a second-user. The remote-controller remotely controls functions of the headphone to interrupt a current audio output of the headphone being delivered from an audio-delivering-device. The remote-controller includes an integrated microphone and receive an audio message. Audio from the microphone is effectively instantly delivered to at least one speaker of the headphones via a wireless channel.

14 Claims, 5 Drawing Sheets

HEADPHONE SYSTEM

CROSS REFERENCE TO RELATED APPLICATION

The present application is related to and claims priority to U.S. Provisional Patent Application No. 62/807,209 filed Feb. 18, 2019, which is incorporated by reference herein in its entirety.

BACKGROUND OF THE INVENTION

The following includes information that may be useful in understanding the present disclosure. It is not an admission that any of the information provided herein is prior art nor material to the presently described or claimed inventions, nor that any publication or document that is specifically or implicitly referenced is prior art.

1. FIELD OF THE INVENTION

The present invention relates generally to the field of electronic devices and more specifically relates to headphones.

2. DESCRIPTION OF RELATED ART

Many children wear headphones and are unable to hear their parents asking them questions or giving them instructions without having to remove the headphones. This process is inconvenient and frustrating for both the parent and the child. The inability to hear can also be dangerous, such as in situations where the child wearing the headphones is walking ahead of the parent and cannot hear traffic or the commands to stop. Children with autism or disabilities often benefit from wearing headphones, but the inability to communicate with them easily is difficult for parents and caretakers.

U.S. Pub. No. 2014/0126733 to Daniel M. Gauger, Jr. relates to a user interface for headphones with active hear-through. The described user interface for ANR headphones with active hear-through includes an active noise reducing headphone has an active noise-cancelling mode and an active hear-through mode, and changes between the noise-cancelling mode and the hear-through mode based on detection of a user touching a housing of the headphone or based on a command signal received from an external device. In another aspect, a signal processor in the headphone is configured to change between the active noise-cancelling and active hear-through modes based on a comparison of signals from a feed-forward microphone and a feedback microphone. During the hear-through mode, the signal processor detects high-frequency signals in the feed-forward path exceeding a threshold level indicative of abnormally high acoustic coupling of the output transducer to the feed-forward microphone, and applies a compressing limiter to the feed-forward path until the high-frequency signals are no longer detected at levels above the threshold.

BRIEF SUMMARY OF THE INVENTION

In view of the foregoing disadvantages inherent in the known electronic devices art, the present disclosure provides a novel headphone system. The general purpose of the present disclosure, which will be described subsequently in greater detail, is to provide a set of headphones and a separate fob with an integrated microphone. The headphone system allows individuals to speak into the microphone to communicate with the wearer of the headphones, effectively eliminating the need for users to remove their headphones in order to hear others.

A headphone system is disclosed herein. The headphone system includes a headphone and a remote-controller including a microphone, and a power supply. The headphone is in wireless communication with the remote-controller. The remote-controller is configured to remotely control functions of the headphone to interrupt a current audio output of the headphone being delivered from an audio-delivering-device. The remote-controller comprises an integrated microphone and is configured to receive an audio message. Audio from the microphone is effectively instantly delivered to at least one speaker of the headphones via a wireless channel. The headphone and the remote-controller when used in combination provide direct communication between a first-user and a second-user. The headphone and the remote-controller are provided for communication between the first-user being a child and the second-user being a parent. Upon reading this specification, it should be appreciated that, under appropriate circumstances, considering such issues as user preferences, design preference, structural requirements, marketing preferences, cost, available materials, technological advances, etc., other electronic and communication arrangements such as, for example, wireless communication, etc., may be sufficient.

A method of communicating between a first-user and a second-user is also disclosed herein, the method comprising the steps of: providing a headphone and a remote-controller including a microphone and a power supply; pairing at least one of the headphones with the remote-controller; activating the microphone; pausing a current audio output of the headphones in response to activation of the microphone; delivering a message from the microphone to speakers of the headphone; resuming the current audio output of the headphones after playing the message; and unpairing at least one of the headphones with the remote-controller.

For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and methods of use for the present disclosure, a headphone system, constructed and operative according to the teachings of the present disclosure.

The various embodiments of the present invention will hereinafter be described in conjunction with the appended drawings, wherein like designations denote like elements.

DETAILED DESCRIPTION

As discussed above, embodiments of the present disclosure relate to an electronic device and more particularly to a headphone system as used to improve communication between a headphone wearer and a parent, caretaker or other user by providing a headset and remote to be used in combination.

Generally, headphone system is a pair of headphones with a corresponding fob that includes an integrated microphone that can be used to communicate directly with the headphone wearer. The system includes a pair of headphones or ear buds. There is a synced microphone in the form of a key fob or necklace which is in wireless communication with the headphones that allows users to speak into the headphones/ear buds. The microphone can be used to communicate with any earphones/buds that are synced to it. The key fob preferably includes a mic button, microphone, and a slide switch to select one or all of the headphones simultaneously. There is a sensor system that works via Wi-Fi to allow the microphone to communicate with the headphones. Individuals are also able to lower the music/content on the headphones in order to speak without startling the user. The system offers safety and convenience for parents and caretakers trying to communicate with children wearing headphones and affords parents peace of mind that their child can hear their commands or instructions while wearing headphones.

Figure 1:
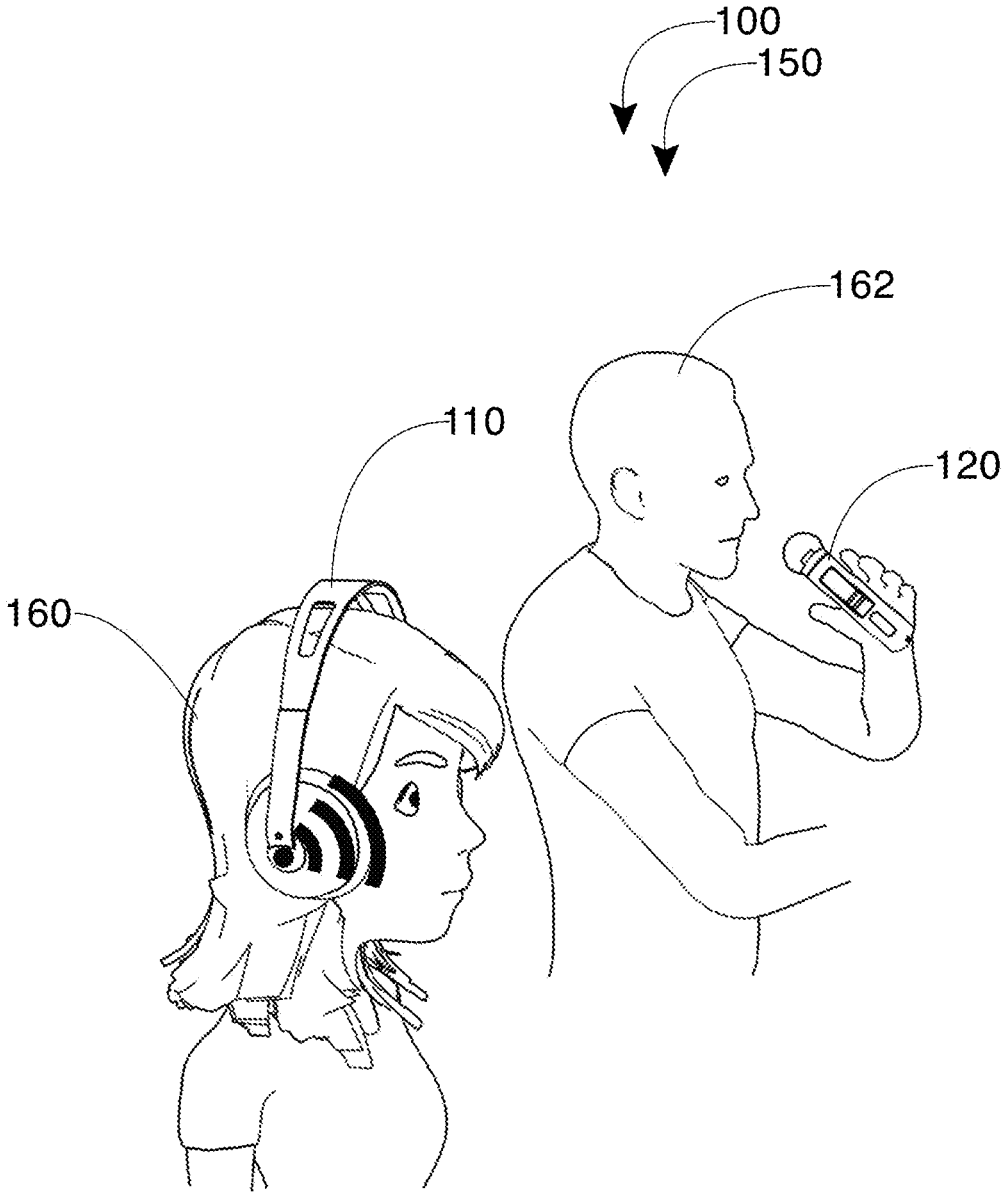
FIG. 1 is a perspective view of the headphone system during an 'in-use' condition, according to an embodiment of the disclosure.

Referring now more specifically to the drawings by numerals of reference, there is shown in FIGS. 1-4, various views of a headphone system 100. FIG. 1 shows a headphone system 100 during an 'in-use' condition 150, according to an embodiment of the present disclosure. As illustrated, the headphone system 100 may include a headphone 110 and a remote-controller 120 including a microphone 122 and a power supply 130. The headphone 110 is in wireless communication with the remote-controller 120. The remote-controller 120 is configured to remotely control functions of the headphone 110 to interrupt a current audio output of the headphone 110 being delivered from an audio-delivering-device. The remote-controller 120 comprises an integrated microphone 122 and is configured to receive an audio message. Audio from the microphone 122 is effectively instantly delivered to at least one speaker of the headphones 110 via a wireless channel. The headphone 110 and the remote-controller 120 when used in combination provide direct communication between a first-user 160 and a second-user 162.

Figure 2:
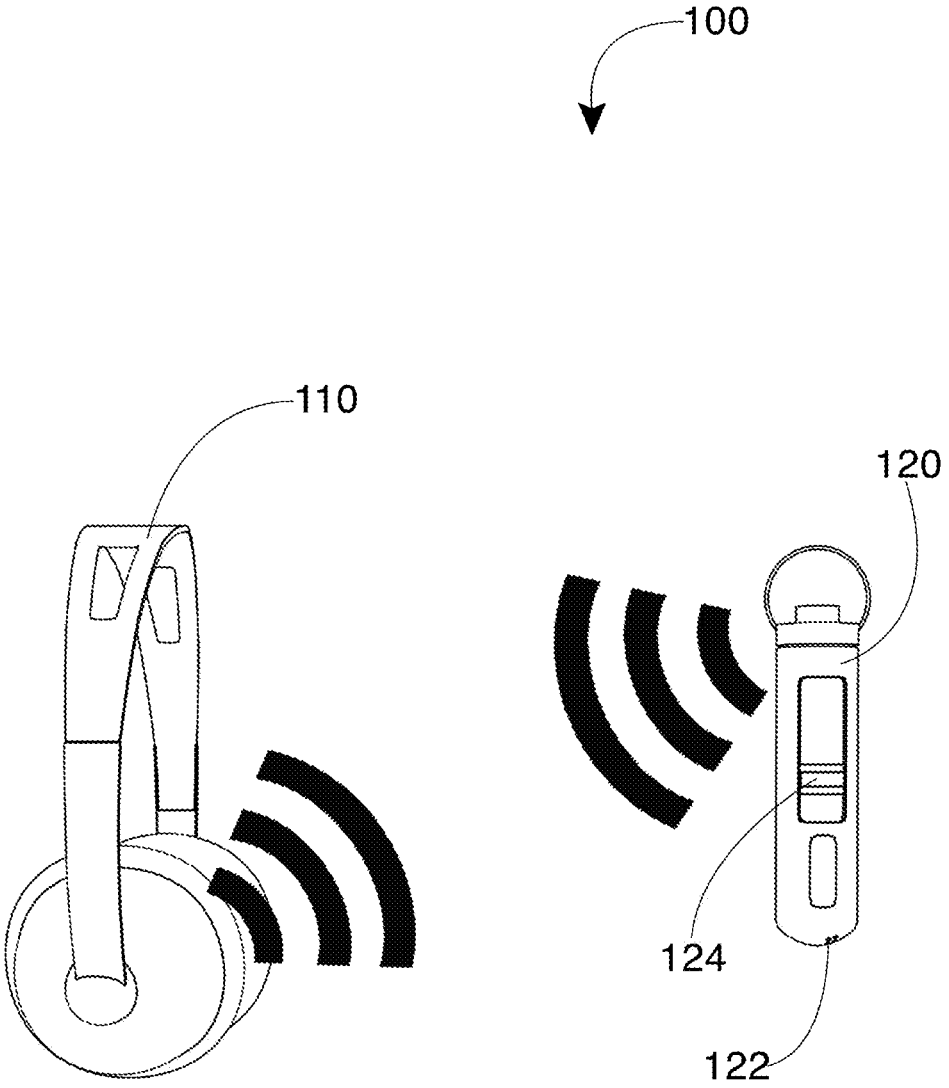
FIG. 2 is a perspective view of the headphone system of FIG. 1, according to an embodiment of the present disclosure.

FIG. 2 shows a perspective view of the headphone system 100 of FIG. 1, according to an embodiment of the present disclosure. As above, the headphone system 100 may include the headphone 110 and the remote-controller 120 comprising the microphone 122 and the power supply 130. The remote-controller 120 may comprise a handheld key fob or other suitable, portable, remote device. In other embodiments, the remote-controller 120 may be provided as a necklace, or necklace attachable device. The remote-controller 120 further comprises a button 132. The microphone 122 is activated via depression of the button 132. When the microphone 122 is activated via the depression of the button 132, the current audio output of the headphone 110 is simultaneously interrupted with the audio from the microphone 122. The wireless communication between the first-user 160 and the second-user 162 is one-way communication from the second-user 162 with the remote-controller 120 to the first-user 160 wearing the headphone 110. The audio from the microphone 122 is delivered in real-time to the speakers of the headphone(s) 110.

Figure 3:
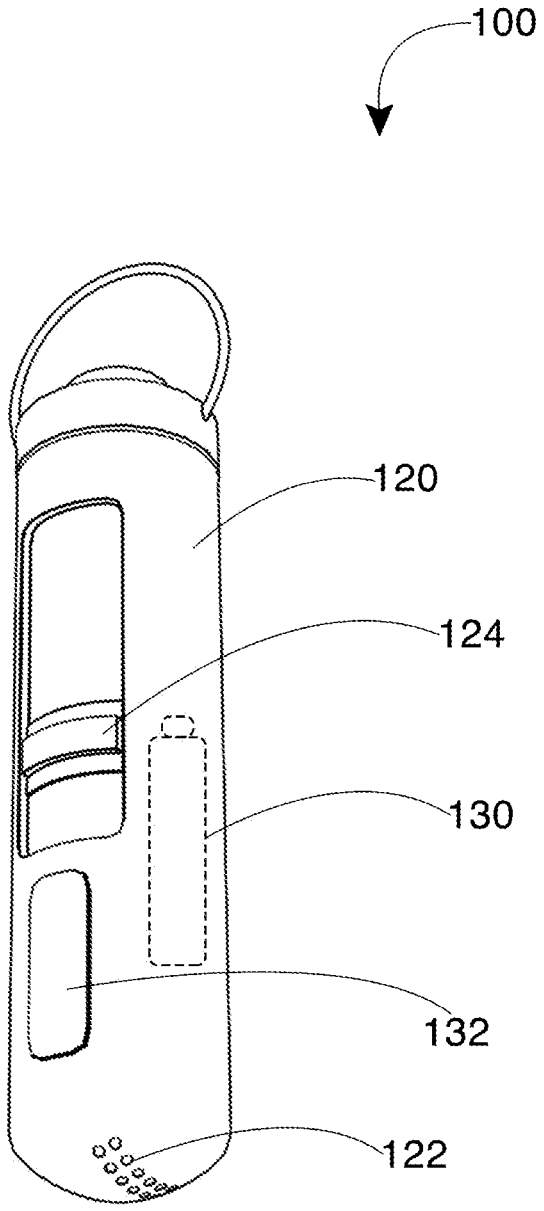
FIG. 3 is a perspective view of the headphone system of FIG. 1, according to an embodiment of the present disclosure.

FIG. 3 shows a perspective view of the headphone system 100 of FIG. 1, according to an embodiment of the present disclosure. As above, the headphone system 100 may include the headphone 110 and the remote-controller 120 working in combination and providing communication means for communication between the first-user 160 being a child and the second-user 162 being a parent. The headphones 110 may include wireless-headphones, non-wireless-headphones, or earbuds. The remote-controller 120 is not physically connected to the headphone 110 and allows the second-user 162 to communicate with the first-user 160 remotely. Audio from the microphone 122 is effectively instantly delivered to a right-speaker 112 and left-speaker 114 of the headphones 110 via a wireless channel. The power supply 130 of the remote-controller 120 comprises at least one battery or other suitable power supply.

Figure 4:
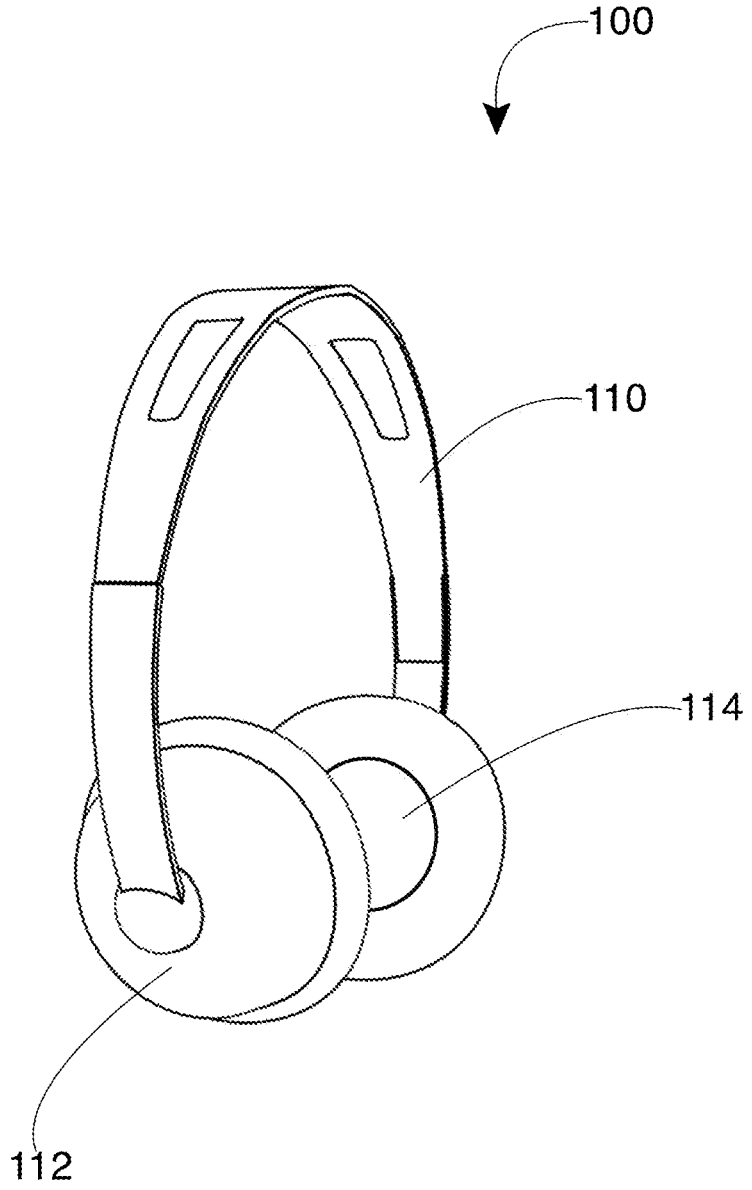
FIG. 4 is a perspective view of the headphone system of FIG. 1, according to an embodiment of the present disclosure.

FIG. 4 shows a perspective view of the headphone system 100 of FIG. 1, according to an embodiment of the present disclosure. As above, the headphone system 100 may include the headphone 110 and the remote-controller 120. The remote-controller 120 is configured to wirelessly connect and communicate with one or a plurality of the headphones 110. The second-user 162 being able to selectively communicate which each one of the pluralities of the headphones 110. The remote-controller 120 further comprises a slidable switch 124. The switch 124 of the remote-controller 120 is manipulatable for selecting one of the pluralities of the headphones 110 to communicate with. The remote-controller 120 is further configured to control a volume of the audio output of the headphone 110.

Figure 5:
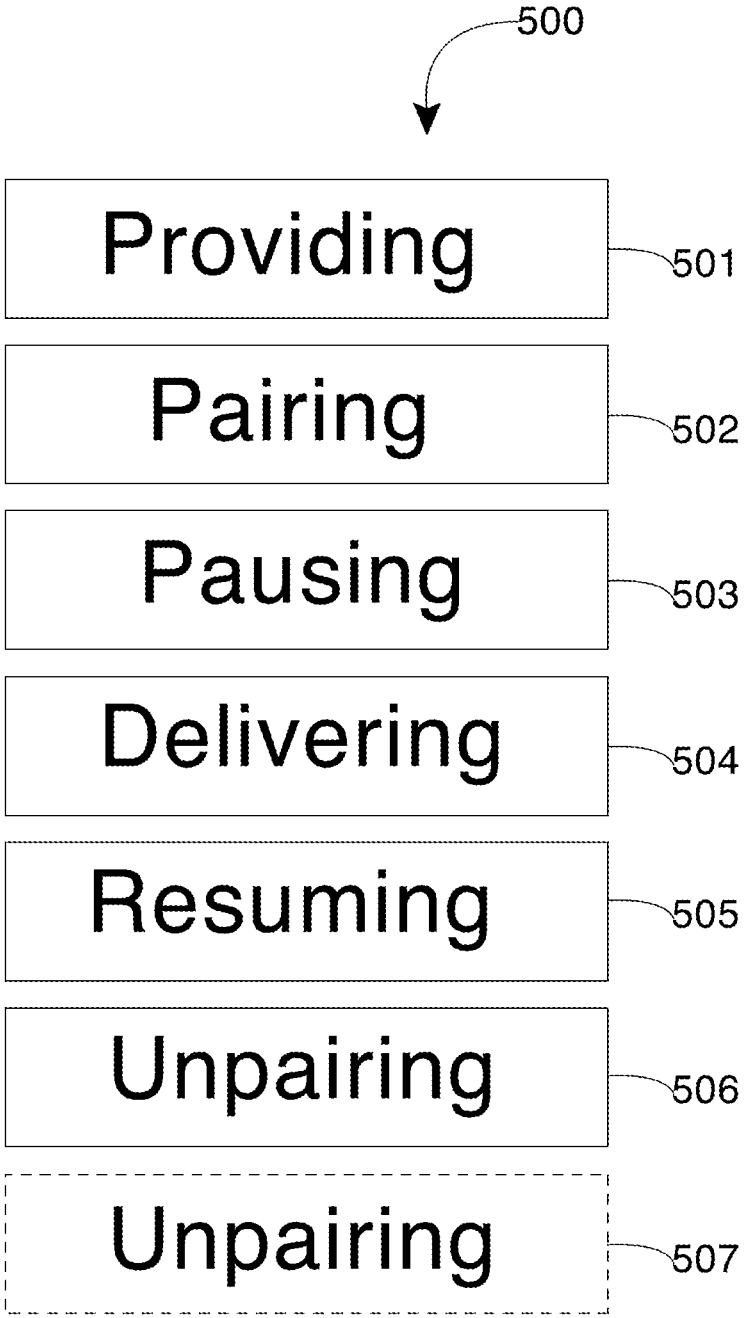
FIG. 5 is a flow diagram illustrating a method of communicating between a first-user and a second-user, according to an embodiment of the present disclosure.

FIG. 5 is a flow diagram illustrating a method for communicating between a first-user and a second-user 500, according to an embodiment of the present disclosure. In particular, a method for communicating between a first-user and a second-user 500 may include one or more components or features of the headphone system 100 as described above. As illustrated, the method of communicating between a first-user and a second-user 500 may include the steps of: step one 501, providing a headphone 110 and a remote-controller 120 including a microphone 122 and a power supply 130; step two 502, pairing at least one of the headphones 110 with the remote-controller 120; activating the microphone 122; step three 503, pausing a current audio output of the headphones 110 in response to activation of the microphone 122; step four 504, delivering a message from the microphone 122 to speakers of the headphone 110; step five 505, resuming the current audio output of the headphones 110 after playing the message; and step six 506, unpairing at least one of the headphones 110 with the remote-controller 120.

It should be noted that step six 506 is an optional step and may not be implemented in all cases. Optional steps of method of use 500 are illustrated using dotted lines in FIG.

5 so as to distinguish them from the other steps of method of use 500. It should also be noted that the steps described in the method of use can be carried out in many different orders according to user preference. The use of "step of" should not be interpreted as "step for", in the claims herein and is not intended to invoke the provisions of 35 U.S.C. § 112(f). It should also be noted that, under appropriate circumstances, considering such issues as design preference, user preferences, marketing preferences, cost, structural requirements, available materials, technological advances, etc., other methods for communicating between a first-user and a second-user, are taught herein.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A headphone system comprising:
one or more headphones; and
a remote-controller including
a microphone;
a button;
a sliding switch able to select between two or more positions; and
a power supply;
wherein said one or more headphones is in wireless communication with said remote-controller;
wherein said remote-controller is configured to remotely control functions of said one or more headphones to interrupt a current audio output of said one or more headphones being delivered from an audio-delivering-device when said button is pressed;
wherein said microphone is integrated in said remote-controller;
wherein audio from said microphone is effectively instantly delivered to at least one speaker of said one or more headphones via a wireless channel;
wherein when said microphone is activated via said depression of said button, and said current audio output of said one or more headphones is simultaneously interrupted with said audio from said microphone;
wherein the remote-controller is able to pair with multiples of the one or more headphones simultaneously;
wherein each of the two or more positions of the sliding switch correspond to a respective one of the one or more headphones;
whereby when the sliding switch is set to one of the two or more positions, the remote controller is able to transmit said audio from said microphone to the corresponding one of the one or more headphones, each one of the two or more positions being configurable to pair with a different one of the one or more headphones; and
wherein said one or more headphones and said remote-controller when used in combination provide direct communication between a first-user and a second-user.

2. The headphone system of claim 1, wherein said remote-controller comprises a handheld key fob.

3. The headphone system of claim 1, wherein said remote-controller is a necklace.

4. The headphone system of claim 1, wherein a position of the two or more positions of the sliding switch enables transmission of audio to all paired devices of the one of the one or more headphones.

5. The headphone system of claim 1, wherein said wireless communication between said first-user and said second-user is one-way communication from the second-user with said remote-controller to the first-user wearing one of said one or more headphones.

6. The headphone system of claim 5, wherein said audio from said microphone is delivered in real-time to said at least one speaker of said one or more headphones.

7. The headphone system of claim 1, wherein said remote-controller is further configured to control a volume of said audio output of said one or more headphones.

8. The headphone system of claim 1, wherein said one or more headphones is selected from a group consisting of wireless-headphones, non-wireless-headphones, and earbuds.

9. The headphone system of claim 8, wherein said remote-controller is not physically connected to said one or more headphones.

10. The headphone system of claim 1, wherein said power supply comprises at least one battery.

11. The headphone system of claim 1, wherein said at least one speaker of said one or more headphones comprises a right-speaker and left-speaker.

12. A method of communicating between the first-user and the second-user, the method comprising the steps of:
providing the headphone system of claim 1;
pairing at least one of said one or more headphones with said remote-controller;
activating said microphone;
pausing a current audio output of said one or more headphones in response to activation of said microphone;
delivering a message from said microphone to said at least one speaker of said one or more headphone; and
resuming said current audio output of said one or more headphones after playing said message.

13. The method of claim 12, further comprising the steps of:
unpairing at least one of said one or more headphones with said remote-controller.

14. A headphone system comprising:
one or more headphones; and
a remote-controller including
a microphone;
a button;
a sliding switch able to select between two or more positions; and
a power supply;
wherein said one or more headphones is in wireless communication with said remote-controller;
wherein said remote-controller is configured to remotely control functions of said one or more headphones to interrupt a current audio output of said one or more headphones being delivered from an audio-delivering-device when said button is pressed;
wherein said microphone is integrated in said remote-controller;
wherein audio from said microphone is effectively instantly delivered to at least one speaker of said one or more headphones via a wireless channel;

wherein when said microphone is activated via said depression of said button, and said current audio output of said one or more headphones is simultaneously interrupted with said audio from said microphone;

wherein the remote-controller is able to pair with multiples of the one or more headphones simultaneously;

wherein each of the two or more positions of the sliding switch correspond to a respective one of the one or more headphones;

whereby when the sliding switch is set to one of the two or more positions, the remote controller is able to transmit said audio from said microphone to the corresponding one of the one or more headphones, each one of the two or more positions being configurable to pair with a different one of the one or more headphones; and wherein said one or more headphones and said remote-controller when used in combination provide direct communication between a first-user and a second-user;

wherein said remote-controller comprises a handheld key fob;

wherein said wireless communication between said first-user and said second-user is one-way communication from the second-user with said remote-controller to the first-user wearing one of said one or more headphones;

wherein said audio from said microphone is delivered in real-time to said at least one speaker of said one or more headphones;

wherein said one or more headphones is selected from a group consisting of wireless-headphones, non-wireless-headphones, and earbuds; and wherein said remote-controller is not physically connected to said one or more headphones.

* * * * *